US006612234B2

(12) United States Patent
Hess

(10) Patent No.: US 6,612,234 B2
(45) Date of Patent: Sep. 2, 2003

(54) LIGHTWEIGHT PORTABLE COMPACT UNIVERSAL PRINTER COATER

(75) Inventor: Max W. Hess, Trophy Club, TX (US)

(73) Assignee: Howard W. DeMoore, Dallas, TX (US)

( * ) Notice: Subject to any disclaimer, the term of this patent is extended or adjusted under 35 U.S.C. 154(b) by 143 days.

(21) Appl. No.: 09/846,663

(22) Filed: May 1, 2001

(65) Prior Publication Data

US 2002/0178944 A1 Dec. 5, 2002

(51) Int. Cl.[7] ..... B41F 5/00; B05C 11/00

(52) U.S. Cl. ..... 101/216; 101/364; 101/479; 101/350.1; 118/46; 118/258

(58) Field of Search ..... 101/216, 479, 101/232, 364, 350.1, 367, 152, 363, 181, 408, 177; 118/46, 126, 258

(56) References Cited

U.S. PATENT DOCUMENTS

| | | | | |
|---|---|---|---|---|
| 2,333,962 A | | 11/1943 | Terry | |
| 3,625,145 A | * | 12/1971 | Heatley, Jr. et al. | 101/152 |
| 3,738,265 A | * | 6/1973 | Saueressig | 101/152 |
| 4,270,483 A | | 6/1981 | Butler | |
| 4,279,949 A | * | 7/1981 | Esser | 118/126 |
| 4,308,796 A | | 1/1982 | Satterwhite | |
| 4,421,027 A | | 12/1983 | Fischer | |
| 4,615,293 A | | 10/1986 | Jahn | |
| 4,685,414 A | | 8/1987 | DiRico | |
| 4,779,557 A | | 10/1988 | Frazzitta | |
| 4,796,556 A | | 1/1989 | Bird | |
| 4,825,804 A | | 5/1989 | DiRico | |
| 4,841,903 A | | 6/1989 | Bird | |
| 4,889,051 A | | 12/1989 | Sarda | |
| 4,934,305 A | | 6/1990 | Koehler | |
| 5,107,790 A | | 4/1992 | Sliker et al. | |
| 5,176,077 A | | 1/1993 | DeMoore et al. | |
| 5,178,678 A | * | 1/1993 | Koehler et al. | 118/46 |
| 5,186,103 A | * | 2/1993 | Gelinas et al. | 101/181 |
| 5,209,179 A | | 5/1993 | Herbert | |
| 5,327,830 A | * | 7/1994 | Gelinas et al. | 101/363 |
| 5,335,596 A | * | 8/1994 | DeMoore et al. | 101/367 |
| 5,598,777 A | | 2/1997 | DeMoore | |
| 5,630,363 A | | 5/1997 | Davis | |
| 5,638,752 A | | 6/1997 | Hartung et al. | |
| 5,651,316 A | | 7/1997 | DeMoore | |
| 5,960,713 A | | 10/1999 | DeMoore | |
| 6,000,336 A | * | 12/1999 | Leib | 101/408 |
| 6,116,158 A | | 9/2000 | DeMoore | |

FOREIGN PATENT DOCUMENTS

| | | |
|---|---|---|
| EP | 0741025 B1 | 1/2001 |
| WO | WO01/28774 A1 | 4/2001 |

OTHER PUBLICATIONS

RDP Marathon, Inc., 2583 Chamedey Blvd., Laval, Quebec H7T2R2 Canada, "LF–200 LithoFlex Promotional Brochure,".

Printing Research, Inc., "Super Blue, PBC Plate/Blanket and PC Plate Coater,".

* cited by examiner

*Primary Examiner*—Eugene H. Eickholt
(74) *Attorney, Agent, or Firm*—Conley Rose, P.C.

(57) ABSTRACT

A lightweight portable compact flexographic universal printer coater adaptable to printing units on the same press or other presses of the same nominal printing width. The printer coater has a frame which comprises an anilox roller, a means to rotate the anilox roller at or near the surface speed of the rotating printing surface, a liquid film supply for replenishing the liquid film on the surface of the anilox roller, and a positioner device to place the printer coater between the on and off-impression positions. The printer coater apparatus is placed onto at least one pair of fixed supports mounted on the printing press frame so that the positioner apparatus can place the printer coater between an on and off-impression position. Spacers of selected widths may be mounted between the fixed supports and the interior surfaces of the press frame to compensate for slightly varying press frame widths associated with different press manufacturers. In the alternative, fixed supports may be manufactured in different widths and mounted on the interior surface of the press frame to avoid the use of spacers. The printer coater is portably liftable into and out of position from the printing press frame and easily transportable to any printing unit of a multiple unit rotary offset lithographic printing press or other rotary offset lithographic presses of the same nominal printing width.

63 Claims, 10 Drawing Sheets

LIGHTWEIGHT PORTABLE COMPACT UNIVERSAL PRINTER COATER

TECHNICAL FIELD OF THE INVENTION

This invention relates to the printing industry, and in particular, to a new lightweight portable and compact flexographic printer coater for movement to any printing unit on a multi-unit rotary offset lithographic printing press for inking or coating purposes.

BACKGROUND OF THE INVENTION

Offset lithography is a process well known in the art which utilizes the planographic method. Image and non-printing areas are essentially on the same plane of a thin metal plate and the distinction between them is maintained chemically. Ink is offset from a plate on the plate cylinder to a rubber blanket on a blanket cylinder and then from the blanket to a substrate supported on an impression cylinder on which printing occurs.

Conventional sheet-fed, rotary offset printing presses typically include one or more printing units through which individual sheets are fed and printed. After the last printing unit, freshly printed sheets are transferred by a delivery conveyor to the delivery end of the press where they are collected and stacked uniformly. In a typical sheet-fed, rotary offset printing press, the delivery conveyor includes endless chains carrying gripper bars with gripper fingers which grip and pull freshly printed sheets from the last impression cylinder and convey them to the sheet delivery stacker.

Printed lithographic ink on the surface of the substrate sheet dries relatively slowly through oxidation and is easily smeared by subsequent transfer cylinders between the individual printing units of the press. Any relative movement of the freshly printed surface relative to a support surface can result in smearing. Modified and specialized equipment and techniques have been developed to combat this problem.

A related problem that is faced in the prior art is the problem of "offsetting" and "set off" of freshly printed ink at the delivery end of the press after the printed sheets are collected and stacked. A similar problem occurs in roll form material produced on a web-fed press. In some printing jobs, offsetting is prevented by applying a protective and/or decorative coating material over all or a portion of the freshly printed sheets. Some coatings are formed of an ultra-violet (UV)-curable or water-dispersed resin applied as a liquid solution over the freshly printed sheets to protect the ink from offsetting or set-off and improve the appearance of the freshly printed sheets. Such coatings are particularly desirable when decorative or protective finishes are applied in the printing of posters, record jackets, brochures, magazines, folding cartons and the like. In cases where coating is to be applied, the coating operation is carried out after the last printing unit, most desirably by an in-line coating application. It is highly undesirable to process the sheet through the press a second time in order to apply coatings, although this is sometimes done for special effects that are not otherwise obtainable.

The ability to overall coat, spot coat or print with aqueous, flexographic and UV curable inks and/or coatings in combination with lithographic, flexographic and waterless printing processes on a rotary offset printing press is highly desirable. Flexographic printing or coating with aqueous, flexographic and UV curable inks from a blanket or a relief plate can permit much heavier wet and dried ink film layers on the substrate. This is largely due to the nature of lithographic inks. Lithographic inks are generally oil based inks that are formulated to print from planographic surfaces based on the principle that oil and water do not mix. Lithographic inks are generally very strong in color value to compensate for the lesser amount that is printed. They are among the strongest of all inks. The average amount of ink transferred to the paper is further diluted by the double split of the ink film between the plate cylinder and the blanket cylinder and between the blanket cylinder and the substrate to be printed in the nip between the blanket cylinder and the impression cylinder. In many situations, only a quarter of the film thickness on the plate is transferred to the substrate. This can make it difficult to obtain sufficient opacity with white or metallic (gold, silver or other metallic) ink or in printing specialized vehicles such as "scratch-and-sniff" materials from a slurry containing encapsulated essence. This often means that sheets or substrate must be removed and transferred to a second type of machine using the flexographic process to apply greater amounts of ink thickness or the sheets must make successive or two or more passes on a lithographic press to achieve desired print quality.

The prior art has attempted to solve these problems to obtain higher applied film weights on lithographic printing presses in a variety of ways.

For example, it is known to provide a printing machine with a downstream coating station having a blanket roller coater associated with a coating application unit for application of a protective coating over the entire printed area of copy sheets or web before they go to the stacker. Jahn, U.S. Pat. Nos. 4,615,293 and 4,706,601 disclose separate duplex coating units disposed downstream of a printing press. These permit coating selected portions of the substrate using a relief plate and they permit blanket coating.

A number of coating units are known which are appended to or mounted upon the final printing station in the press. Most of these coating units prevent the printing unit on which it is mounted from doing its normal printing function resulting in the loss of one printed color. A four color press using such a coating apparatus would permit printing only three colors in line in a single pass operation because the last station is converted to a flexographic printer-coater. Bird, U.S. Pat. Nos. 4,796,556 and 4,841,903 disclose a liquid application station for the final downstream printing station which converts the lithographic station to a printing coater or a continuous film coater by moving a carriage having a coating unit into impression with the plate or blanket cylinder of the last station on the press. When the coater is used, the normal lithographic printing function on that station is inoperative. DiRico, U.S. Pat. No. 4,685,414 discloses a process and apparatus in use in combination with the last station of an existing offset lithographic press where the coating means is retractable to be used or not as a printer requires. Since the DiRico coater utilizes a blanket cylinder on the last unit of the press, this last unit cannot be used for color printing when it is used for coating. DeMoore, et al., U.S. Pat. No. 5,651,316 discloses a retractable printer-coater unit which though not limited to the last printing station of an offset lithographic press, is useful for lithographic or flexographic printing when the ordinary lithographic operation of the station in which it is mounted is not being used. The lithographic operation of the station is lost when this printer-coater is in operation. Sarda, U.S. Pat. No. 4,889,051 illustrates a retractable lithographic printing unit which does not disable normal lithographic printing on the lithographic printing station. It enables printing another lithographic color at a station by adding a second blanket roller and a retracting inked and dampened applicator for the second blanket roller of the printing station.

Koehler, et al., U.S. Pat. Nos. 4,934,305 and 5,178,678 disclose a flexographic liquid film applicator unit which employs a special "blanket" cylinder which engages the substrate on the impression cylinder of the last lithographic printing station on a multicolor lithographic press. The unit slides in and out on "inclined tracks". Manual reengagement and registration of a drive gear on the applicator with a press drive gear using "index" marks is required to reset the applicator "blanket" cylinder after the unit has been moved away from the printing station.

DeMoore, et al., U.S. Pat. No. 5,176,077 is a delivery cylinder coater for use on the final printing station of a lithographic printing press. The delivery cylinder is provided with a coating blanket. A flexographic applicator roll applies liquid coating to the delivery cylinder as it rotates into the freshly lithographically inked surface of the sheets coming off the press. The coating pickup anilox roller frictionally engages the surface of the delivery cylinder and is rotated by a hydraulic motor.

Much of the prior art has disadvantages. Retrofitting existing presses is often difficult because of space considerations, especially between printing units. A dedicated coating unit is often not possible because of limited space and involves press downtime and substantial capital costs. Retrofitted devices that utilize the print cylinder or blanket cylinder of the press can limit the ability of that station to lithographically print in the normal manner.

Coaters which utilize the plate cylinder or the blanket cylinder of the printing unit still suffer from the disadvantage that the coating is split which reduces the wet film thickness that can be applied to the substrate itself. A few add on coating units that print directly on the substrate on the impression cylinder or a transfer cylinder are limited to the last printing station on the press where there is more room for installation. Such equipment can be moved away or the operator can do the make ready work on the opposite side of the last printing station in the conventional work space for the operator. If such equipment is mounted in the interstation space on a lithographic press, the equipment interferes with operator access to the next station.

Much of the prior art consumes large areas of space on the press, both between printing units and in some instances in the overhead area. Because of the complexity and size of equipment, limited locations are available for which it can be used. Additionally, the prior art devices are heavy; thus, when installing these devices, cranes or similar equipment are often required to properly mount the devices in position. A further disadvantage is that these devices are expensive to manufacture and maintain. Finally, the prior art devices are not designed as portable devices for placement on different printing presses or on different printing units. Most printer coater devices are attached to a single printing unit and require extensive connections that must be disconnected requiring extensive labor and costs. Also, as stated previously, each time a printer coater is moved, a crane or other transport device is required to remove and carry the printer coater to a different printing unit.

It is preferable not to have to cut into press frame to gain access to the main gears and not to have to manually engage and disengage indexed gear teeth of gears on the coater with gears on the press. The ability to flexographically coat, spot coat or print on the substrate at an intermediate printing station with an apparatus that is inexpensive and compact so that it can fit into small areas is highly desirable. It is also desirable to have a lightweight and portable device so that it can be carried by humans for use on any printing unit of a lithographic printing press or to a completely different printing press of the same size and installed or removed without the use of heavy equipment. The present invention is able to fulfill these needs and more.

SUMMARY OF THE INVENTION

The present invention provides a portable universal apparatus for application of flexographic inking or coating substances to printed material on a lithographic printing press, such as those manufactured by Heidelberg Speedmaster, Komori, M.A.N. Rowland, Mitsubishi and other presses of the same nominal width. The apparatus is configured to be placed on any printing unit of a rotary offset lithographic printing press with minimal modification to the printing press. The apparatus is compact, inexpensive and lightweight to allow portability so that it may be transported and used on any printing unit of the printing press or transported to a different printing press which is manufactured by the same or a different manufacturer. The printer coater itself is designed for a given printing format.

The entire printer coater apparatus is constructed as a unit and includes a liquid chamber to hold printing liquid, an applicator roller to receive and apply the printing liquid to a rotating printing surface, a means to drive or rotate the applicator roller and a positioner device to place the printer coater between the on and off-impression positions. The printer coater apparatus comprises a movable frame to support and hold the components of the apparatus. A rotating printing surface is meant to include a plate on the plate cylinder or a plate or blanket on the blanket cylinder as the printer coater apparatus may be installed adjacent a plate cylinder or adjacent a blanket cylinder.

The applicator roller is most preferably a lightweight anilox roller made of a non-metallic composite material. The roller surface is designed to be wear resistant and capable of applying the printing ink or coating material to the rotating printing surface. The anilox roller is journaled into the printer coater side members so that it is capable of rotation by a remotely controlled electrical motor, also mounted onto the frame of the printer coater apparatus. Rotation of the anilox roller is most preferably performed by an electrical motor, however, an equivalent means such as a hydraulic motor may be used.

The liquid chamber, also mounted to the printer coater frame, provides a means to apply the inking or coating to the anilox roller. Attached to the liquid chamber by a quick connect mechanism are a pair of flexible conduits for supplying inking or coating liquid to the chamber. One hose supplies liquid to the inking chamber that is pumped from a remote reservoir and the other hose is connected to a vacuum pump and used to re-circulate unused fluid back to the remote reservoir for maintaining a fresh supply of inking or coating substance.

A positioner device carried by the printer coater frame moves the printer coater apparatus between the on and off-impression positions. When in the on-impression position, the coating or inking substance is applied to a rotating printing surface. When placed in the off-impression position, the printer coater is retracted from the rotating printing surface to stop liquid application. The positioner device most preferably comprises a pneumatically operated cylinder; however, other devices such as a hydraulically or electrically operated device may be used. In order to establish the on-impression position for the printer coater, an adjustable on-stop is mounted on each side of the printer coater frame which cooperates with a stop surface on the fixed support.

The printer coater attaches to the printing press with little modification to the press frame. Fixed supports are mounted on the interior surface of the press frame adjacent a rotating printing surface, one on the drive side and the other on the operator side of the press frame. Each fixed support member comprises a rail so that the printer coater may slide upon as it is inserted and moved into the printing unit. The fixed supports serve two main purposes: to provide a "track" for sliding the printer coater into the right position and to support the printer coater while mounted in the printer unit. A pair of fixed supports can be mounted unobtrusively on each and every printing unit so the printer coater can be removed from one unit and immediately installed on a different printing unit. These fixed supports do not interfere with access to the printing unit when the printer coater is removed from the printing unit.

Connected to the bottom of the printer coater apparatus is a pair of lock-on members that releasably connect the printer coater frame with the fixed supports. The lock-on members serve as an anchor for relative movement of the printer coater apparatus as it is moved by the positioner on and off-impression.

Mounted on the printer coater frame end members are handles that allow the users to carry the printer coater apparatus. The unit weights approximately 85 pounds and can be easily carried and transported by two humans. Most preferably, the printer coater apparatus is mounted adjacent the blanket cylinder delivery side for best performance and results. However, other appropriate locations for mounting the apparatus include the feed side of the blanket cylinder and adjacent the plate cylinder.

Often different press manufacturers for printing presses of the same nominal printing width will have varying lengths between the interior sides of a press frame. The present invention can be adapted for use on any printing press of the same nominal printing width, regardless of the press manufacturer. Thus, it is unnecessary to construct additional printer coaters. In order to compensate for larger press widths, spacers of various thickness can be mounted between the fixed supports and the interior surfaces of the press frame. In addition, the fixed supports can be made of varying thickness so that spacers are not necessary.

BRIEF DESCRIPTION OF THE DRAWINGS

A more complete understanding of the invention and its advantages will be apparent from the following detailed description when taken in conjunction with the accompanying drawings in which.

DETAILED DESCRIPTION OF THE INVENTION

Figure 1:
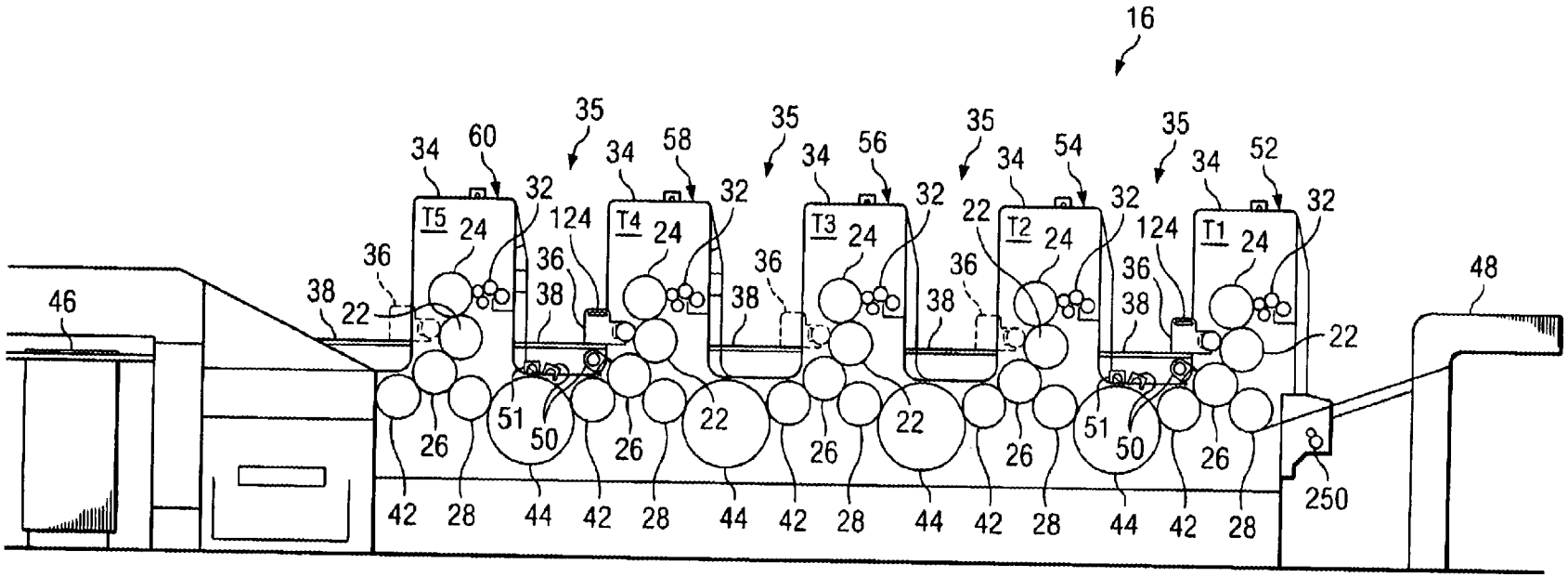
FIG. 1 is a simplified side view of a five station rotary offset lithographic printing press showing the portable inking/coating apparatus of the invention placed on the first and fourth printing unit at the blanket cylinders and in phantom illustrating other positions where the inking/coating apparatus may also be placed.

The present invention is a new and improved lightweight portable compact printer coater 36 for use on a sheet-fed or web-fed rotary offset lithographic printing press, herein generally designated 16. Referring to FIG. 1, rotary offset printing press 16 includes a press frame 34 coupled at one end to a sheet feeder 48 from which sheets to be printed are fed into the printing press. On the opposite end, a stacker 46 collects and stacks the freshly printed sheets. Between sheet feeder 48 and stacker 46 are five substantially identical sheet printing units 52, 54, 56, 58 and 60 which can lithographically print five different colors onto the sheets as they are transferred through the press 16. As illustrated, the printing units 52, 54, 56, 58 and 60 are identical and of conventional design. Each printing unit includes an in feed transfer cylinder 28, a plate cylinder 24, a blanket cylinder 22 and an impression cylinder 26. These cylinders are supported for rotation by printing press frame 34 which define printing unit towers T1, T2, T3, T4 and T5. Each of the first four printing units have a transfer cylinder 42 disposed to transfer the freshly printed sheets from the adjacent impression cylinder 26 to the next printer unit via an intermediate transfer cylinder 44.

As shown in FIG. 1, the lightweight portable compact printer coater 36 can be installed on any printing unit of press 16. Printer coater 36 is positioned above raised catwalk 38 on the first and fourth printing units adjacent blanket cylinder 22. Printer coater 36 is lightweight and compact so that humans can remove and carry the apparatus from a given printing unit for placement on different printing units or printing presses in little time and with minimal difficulty. Phantom lines on FIG. 1 illustrate other positions where printer coater 36 may be placed on press 16 in impression with a rotating printing surface.

Figure 2:
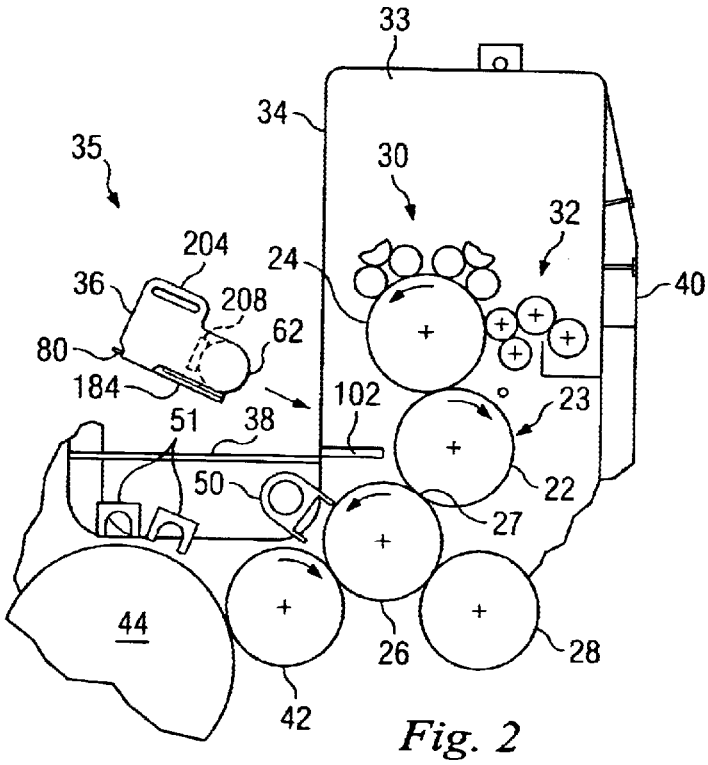
FIG. 2 is a simplified side view of a rotary offset printing press printing unit as seen in FIG. 1 showing the portable inking/coating apparatus of the invention being inserted into the printing unit for placement adjacent the blanket cylinder.
Figure 9:
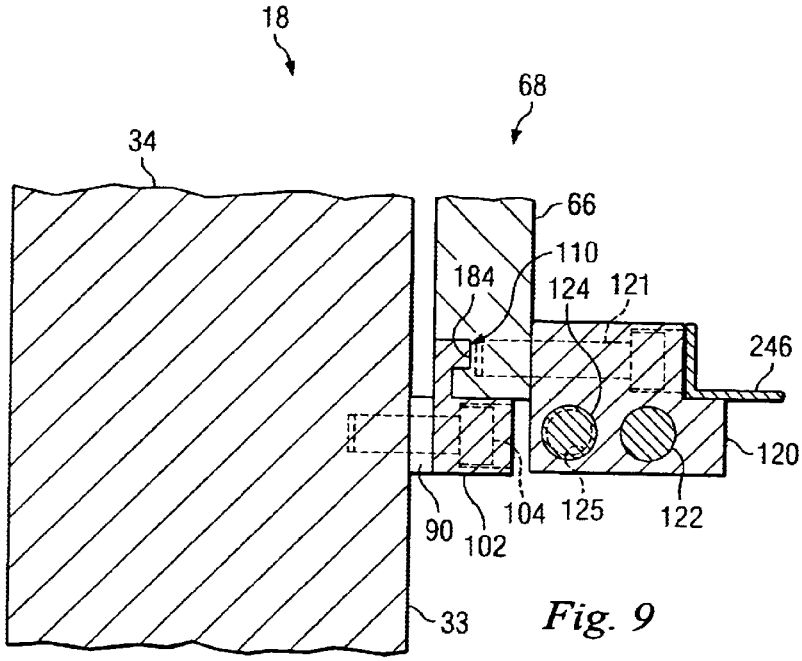
FIG. 9 shows a partial section view of the printer coater frame and press frame connection taken on the line 9—9 in FIG. 6.

Referring to FIG. 2, a close up view of a printing unit on press 16 shows plate cylinder 24 in operation with inking roller train 30 and dampening system 32. Blanket cylinder 22 is located beneath plate cylinder 24, where the printer coater apparatus is preferably placed. In this figure, printer coater 36 is being aligned and inserted into position adjacent blanket cylinder 22. A pair of fixed supports 102 are mounted parallel to each other and attached to the interior surfaces 33 of frame 34. One support is placed on the drive side and the other support is placed on the operator side. FIG. 2 illustrates one fixed support 102 mounted on the drive side of press 16. Fixed supports 102 provide support for printer coater 36 when the apparatus is placed inside the printing unit. When inserting printer coater 36, side member slots 184 seen in FIG. 9 are aligned with fixed supports 102 so that the printer coater may be moved into position.

Figure 3:
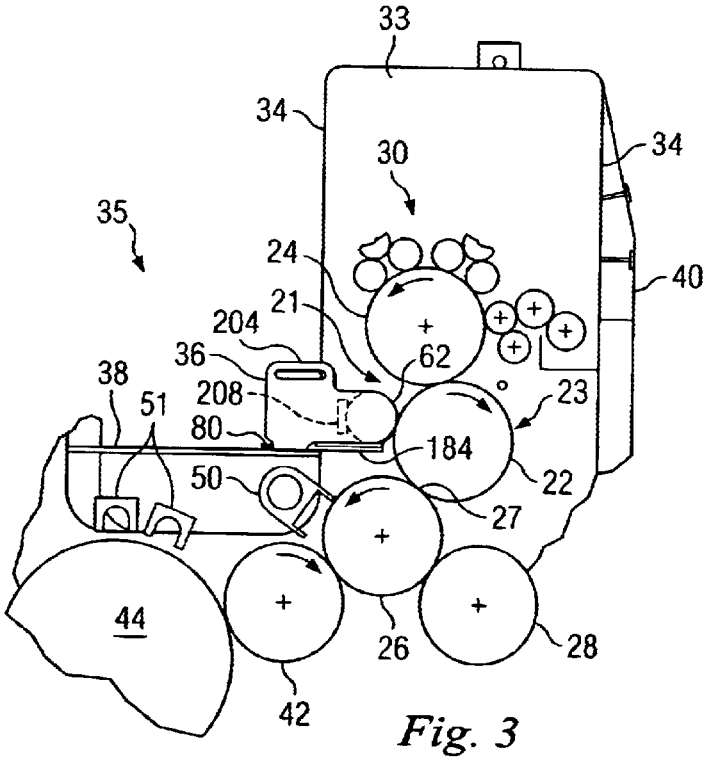
FIG. 3 is a simplified side view of the rotary offset printing unit of FIG. 2 after it has been moved into inking/coating position adjacent the blanket cylinder.

Referring to FIG. 3, printer coater 36 is positioned on the same printing unit as shown in FIG. 2. Printer coater 36 is aligned with blanket cylinder 22 and is supported by fixed supports 102. Printer coater 36 rests slightly above raised catwalk 38 consuming minimal space to allow operator access at interstation area 35. While in the on-impression position, printer coater 36 applies a flexographic inking or coating substance to blanket cylinder 22 which rotates synchronously with impression cylinder 26. The printing substrate, which is paper or other material in sheet or web form, is fed over impression cylinder 26 and is in printing contact with blanket cylinder 22. When the substrate passes contact point 27, it is dried by dryer 50. As the substrate continues to the next printing unit and over intermediate transfer cylinder 44, it is further dried by a drying means 51. Drying means 51 can include high velocity air with or without extraction, ultra-violet radiation, infra-red radiation or other suitable drying means.

Figure 4:
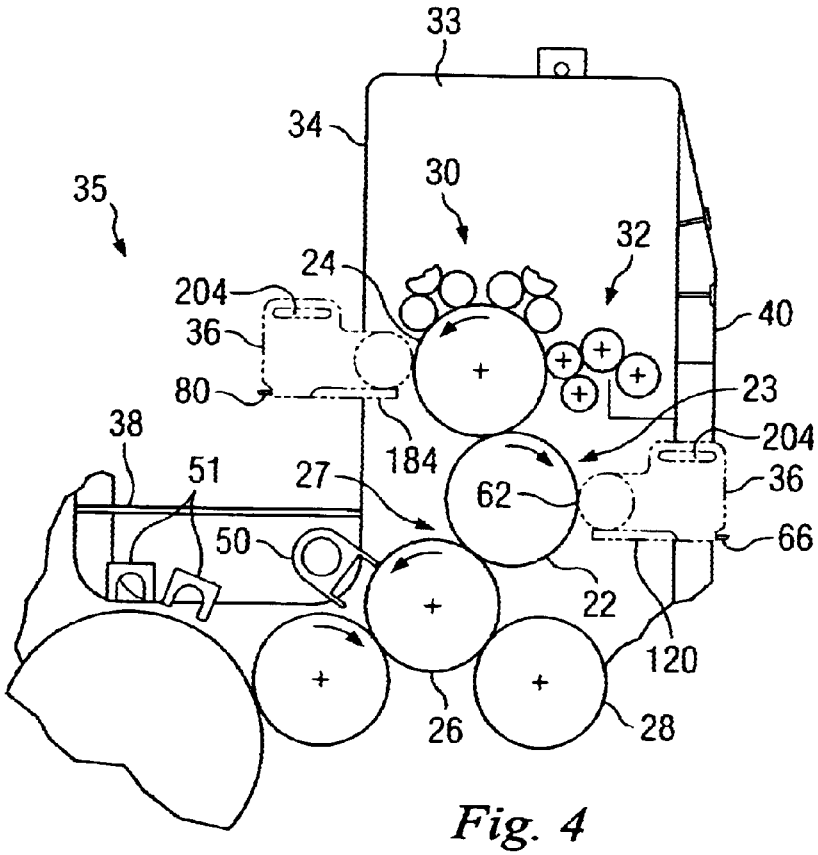
FIG. 4 is a simplified side view of a rotary offset printing unit of FIGS. 1–3 showing the inking/coating apparatus may be placed in alternative positions adjacent the plate cylinder and adjacent the blanket cylinder on the feed side.

FIG. 4 illustrates alternate placement positions on a printing unit of press 16 for printer coater 36. As seen, the printer coater can be placed adjacent plate cylinder 24 or adjacent blanket cylinder 22 on feed side 35. In such case fixed supports 102 are mounted at appropriate places on the innersides of the press frame 34.

Figure 5:
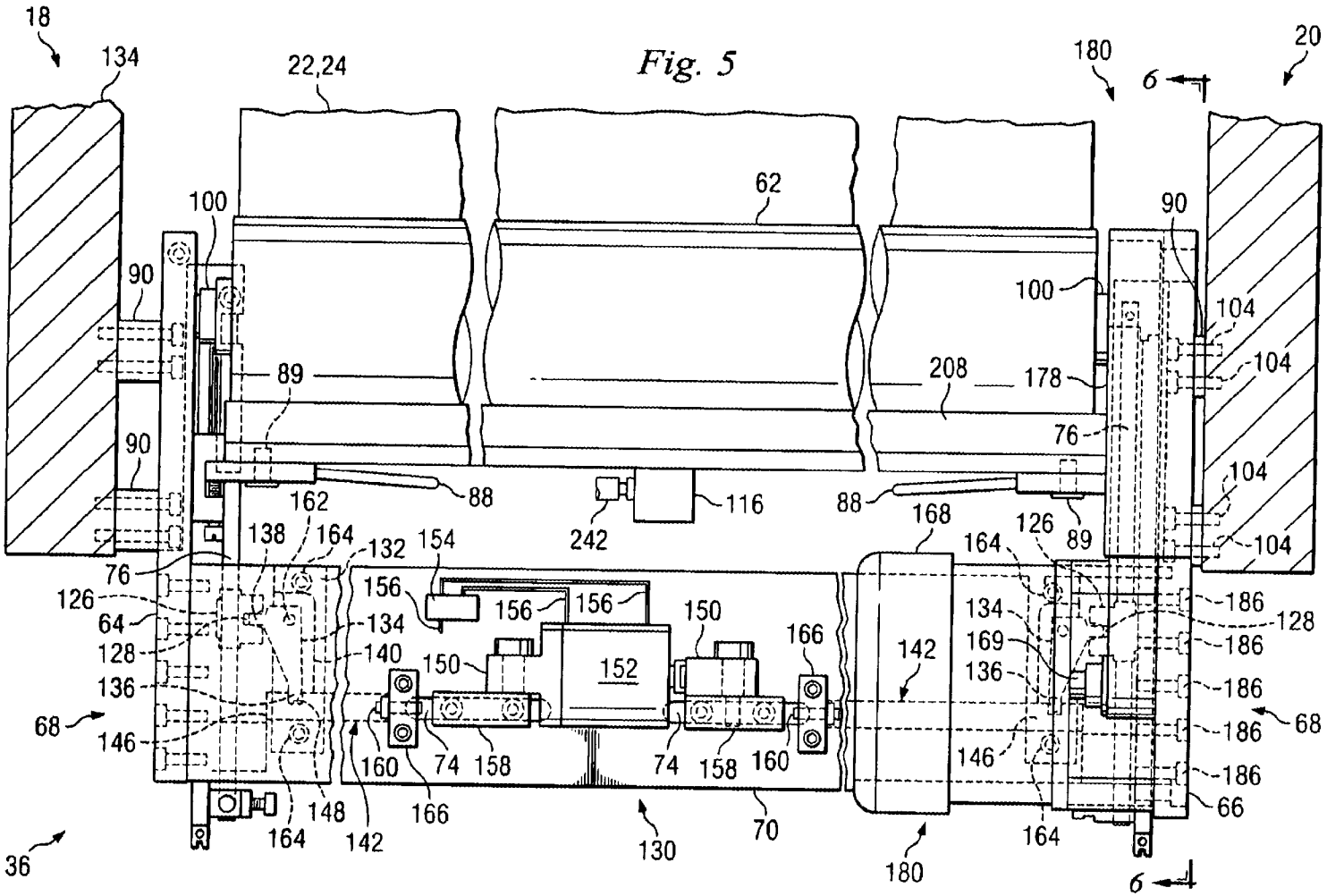
FIG. 5 show a top plan view of the printer coater apparatus of FIGS. 1–4 mounted to the printing press frame.

FIG. 5 exhibits a top view of printer coater 36 mounted to frame 34. Printer coater apparatus 36 comprises a drive side side member 64, an operator side side member 66 and a base or cross member 70 that rigidly connects the side members. All of these components form printer coater frame 68. Frame 68 supports applicator roller 62, drive assembly 180 (as best seen in FIG. 6), liquid chamber 208, and positioner 130 best seen in FIGS. 8 and 11.

In FIG. 5, applicator roller 62 is mounted on stub shafts 100 which are supported at opposite ends by two bearings (not shown), one bearing mounted on each side member 64 and 66. The bearings permit free rotation of applicator roller 62, which is rotated by electric motor 168. Applicator roller 62 is preferably an anilox metering roller which transfers measured amounts of printing ink or coating material to a rotating printing surface. Anilox roller 62 is preferably a lightweight anilox roller made of a non-metallic composite material having a wear resistant ceramic anilox surface for applying printing ink or coating material. Anilox roller 62 can be fabricated by and purchased from Pamarco Global Graphics 500 Wharton Circle S.W., Atlanta, Ga. 30336.

Figure 6:
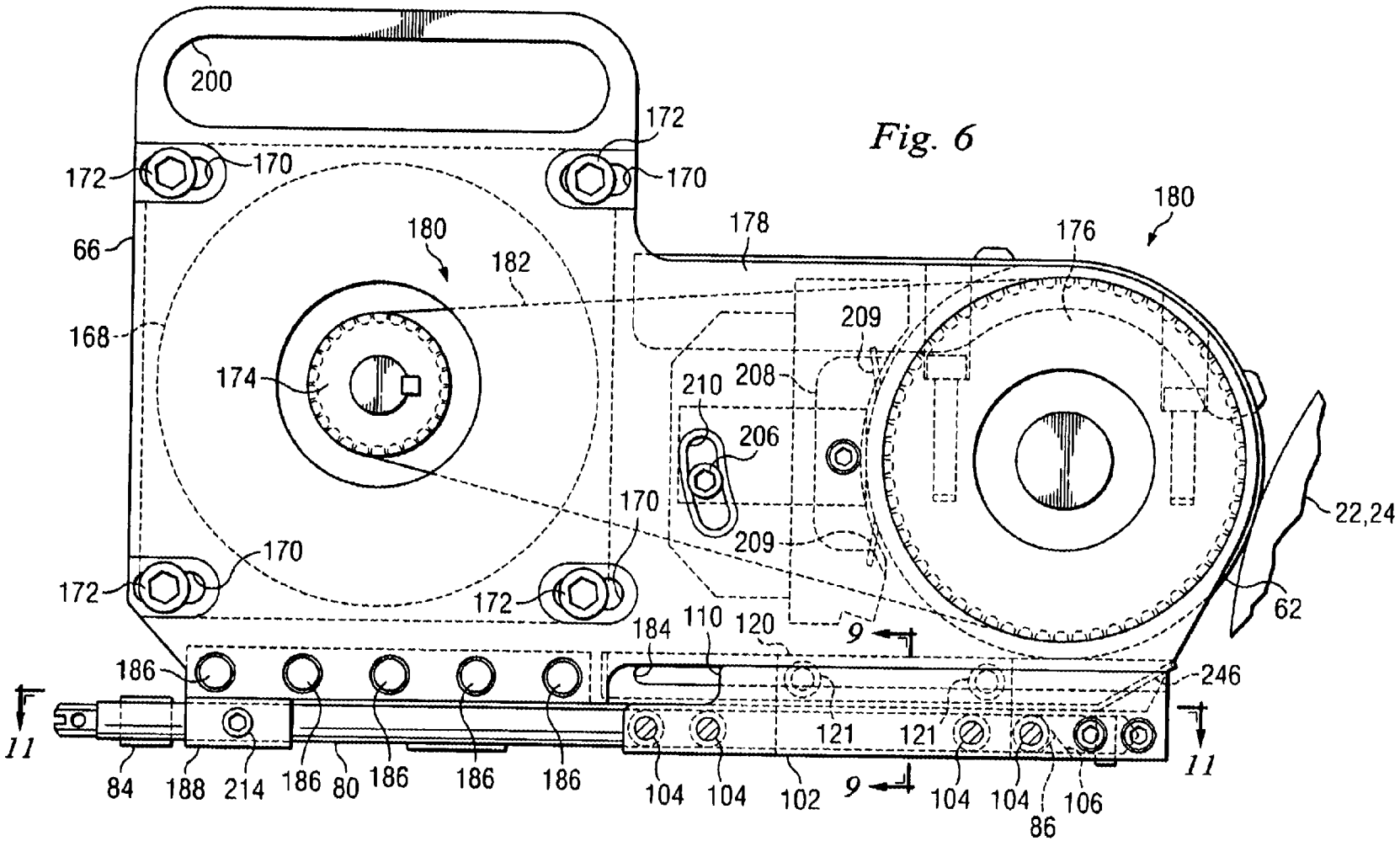
FIG. 6 is a side end view of the printer coater apparatus of the invention viewed from the operator side of the press.

Referring now to FIG. 6, liquid chamber 208 is mounted on frame 68 adjacent roller 62 to supply fluid inking or coating materials to roller 62. The inking or coating fluid is preferably a flexographic or IR curable inking or coating material. Liquid from chamber 208 flows onto the surface of roller 62 to replenish the wet film as the anilox roller rotates through the chamber. The transfer surface of the anilox roller is "doctored" (wiped or scraped) by reverse doctor blades 209, as seen in FIG. 6, to remove excess ink or coating material. Furthermore, doctor blades 209 and suitable end seals (not shown) also provide a seal for the liquid supply chamber. Air bubbles entrapped on the surface of anilox roller 62 are displaced by wiping the surface of the applicator roller with bristles of a brush (not shown) located inside liquid supply chamber 208, as set forth in U.S. Pat. Nos. 5,425,809 and 5,989,639, assigned to Printing Research, Inc., which are incorporated herein by reference. This promotes the flow of inking or coating materials onto applicator roller surface 62.

Referring back to FIG. 5, hose 242 connects to fluid entry port 116 on chamber 208 to direct fresh inking or coating substance inside the chamber. Fluid return hose 244 shown in FIG. 12 directs the excess liquid or inking substance from chamber 208 so that fresh liquid can be re-circulated into the chamber 208. These hoses are easily connected to and disconnected from printer coater 36 by quick release connections (not shown). Located on each end of chamber 208 are a pair of quick release handles 88, which pivot about pivot pin 89 to permit quick removal of the chamber from the printer coater frame.

Figure 8:
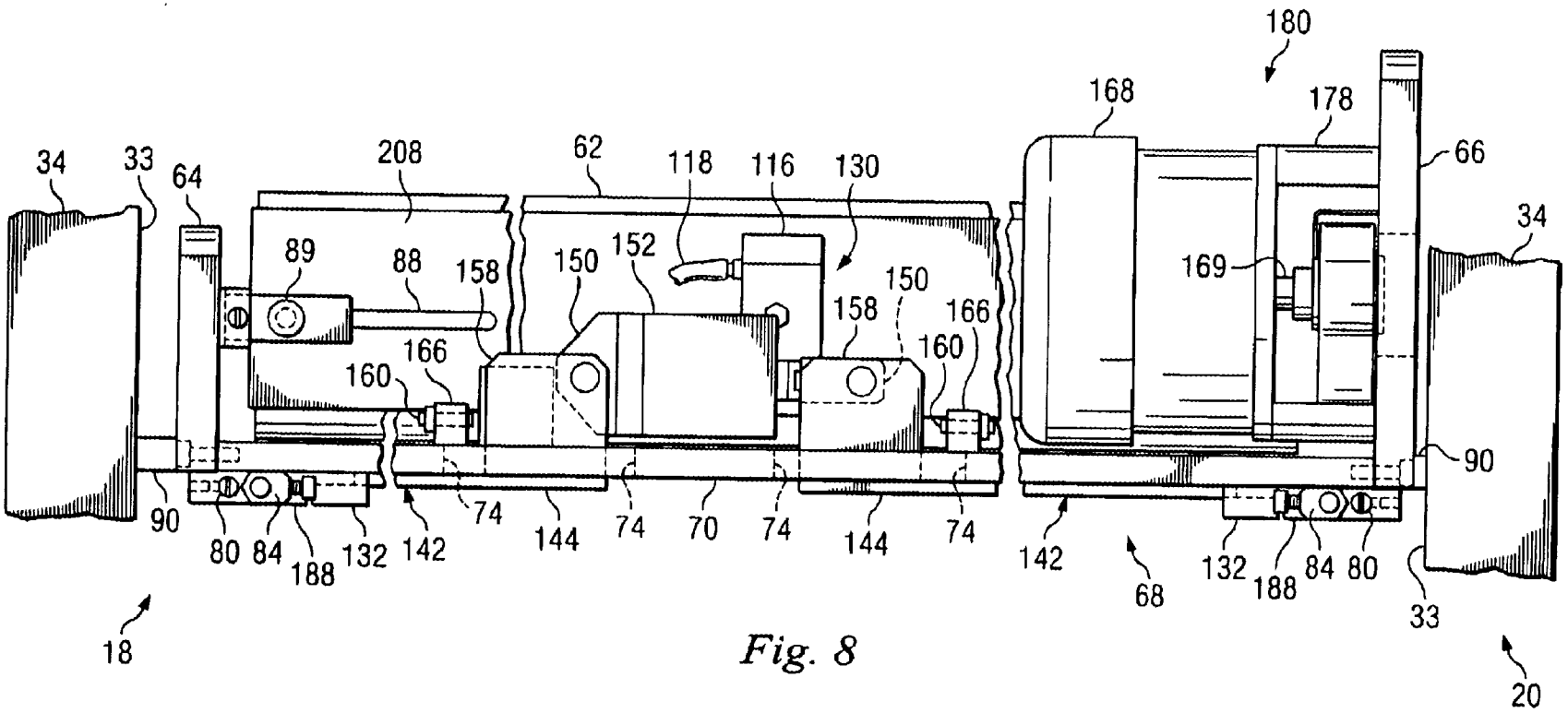
FIG. 8 is an elevational view of the printer coater apparatus from the back side showing the positioner apparatus and a drive motor connected to the printer coater frame.
Figure 11:
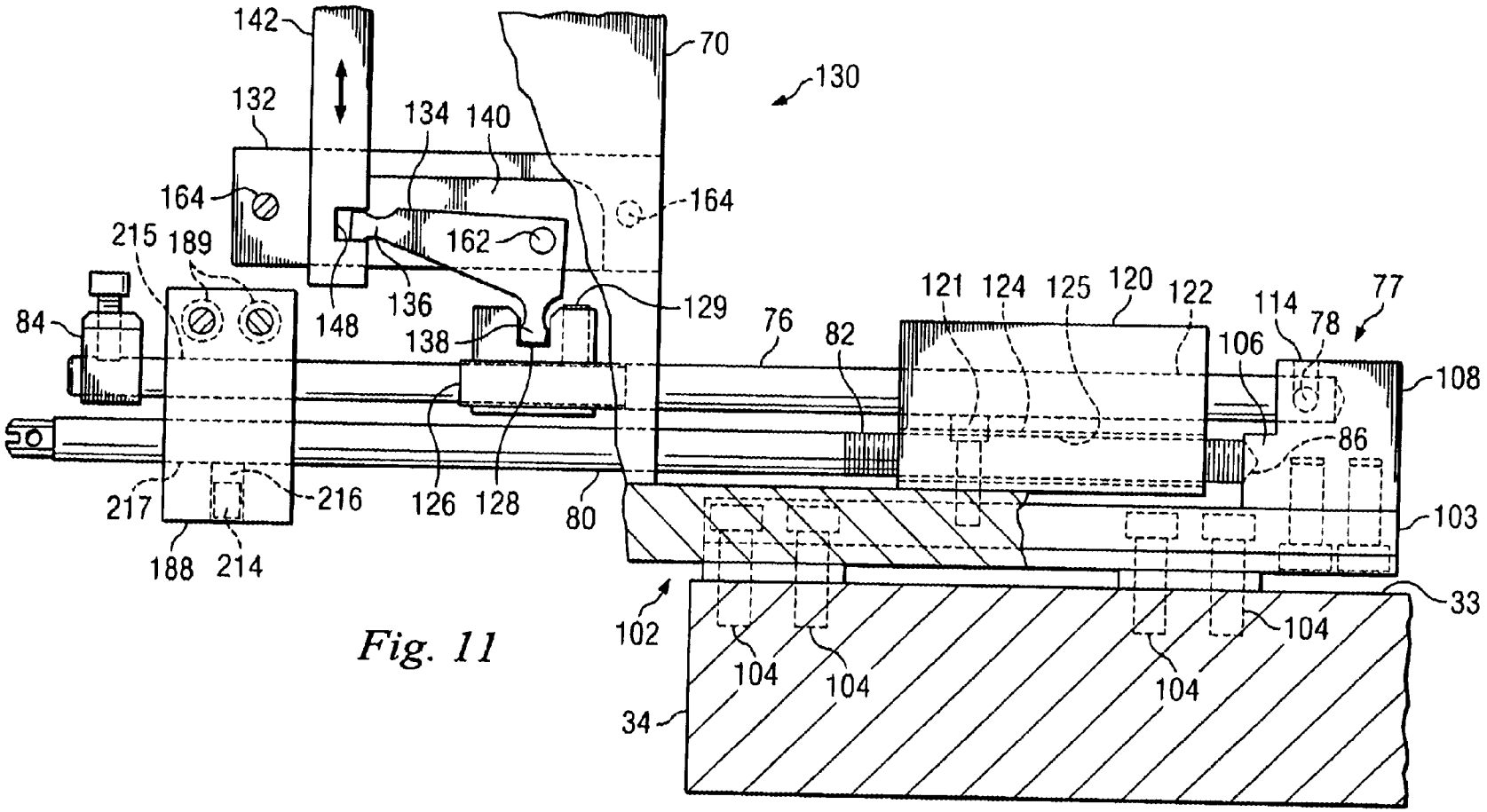
FIG. 11 shows a partial top plan view of one side of the printer coater apparatus after it is connected and locked to the press frame.

As seen in FIGS. 5 and 8, positioner 130 comprises a floating two way or double acting air cylinder 152 mounted above cross member 70. Air is supplied to cylinder 152 by air hoses 156 and is regulated by solenoid 154, which directs air into cylinder 152 to reciprocate the cylinder in the desired direction. Cylinder 152 has two brackets 150 connected to the cylinder and cylinder piston rod respectively which move in the transverse direction (toward side members 64 and 66) upon actuation of the cylinder. Cylinder 152 is not attached to printer coater frame 68 and floats to permit symmetrical movement of the brackets on both sides of the cylinder. Attached to brackets 150 are connecting members 158. These members are vertically oriented and extend beneath cross member 70 through slot 74. Two horizontally placed rigid members 142 are mounted below cross member 70 and attached to members 158. Examining rigid member 142 on drive side 18, member 142 has a first end 144 attached to connecting member 158 and a slot 148 on second end 146 (FIG. 5) to pivotally connect first arm 136 of bell crank 134. Bell crank 134 is pivotally mounted by means of pivot pin 162 to a housing 132. Housing 132 is rigidly fastened to cross member 70 by attachment bolts 164. Second arm 138 of bell crank 134 pivotally attaches to slot 128 on sleeve 126 which is securely mounted to lock-on 76 by set screw 129 (FIG. 11). Attachment and configuration for rigid member 142 on operator side 20 is the same as it is for the drive side attachment and configuration.

With reference to FIGS. 5 and 11, when air cylinder 152 actuates outwardly, rigid members 142 reciprocate in the transverse direction toward side members 64 and 66 causing bell cranks 134 to pivot. As a result of the pivoting motion, a force is exerted toward the blanket cylinder on sleeve slots 128. Because lock-on members 76 and sleeves 126 remain stationary with respect to the printer coater, they function as an anchor for relative movement of the printer coater and a track for the apparatus to slide thereon. Thus, the force from bell cranks 134 cause housings 132 and cross member 70 to move printer coater 36 in the longitudinal direction away from the blanket cylinder. The movable components will stop at a predetermined distance established by stop-blocks 166. Blocks 166 are affixed to the surface of cross member 70 and stop the motion of connecting members 158 as they are pushed toward side members 64 and 66. This establishes the outermost distance the printer coater will travel. Blocks 166 further comprise a fine adjustment screw 160 to adjust the distance that cross members may travel in the transverse direction.

When connecting members 158 are in contact with blocks 166, the printer coater is in the off-impression position. The printer coater remains at this position until cylinder 152 is actuated and retracts connecting members 158 inward away from members 64 and 66. This motion rotates cranks 134 so that bell crank second arm 138 exerts a force on sleeve slot 128 in a direction opposite the rotating printing surface. The force on sleeve slot 128 causes printer coater 36 to move in the longitudinal direction toward the rotating printing surface.

Figure 7:
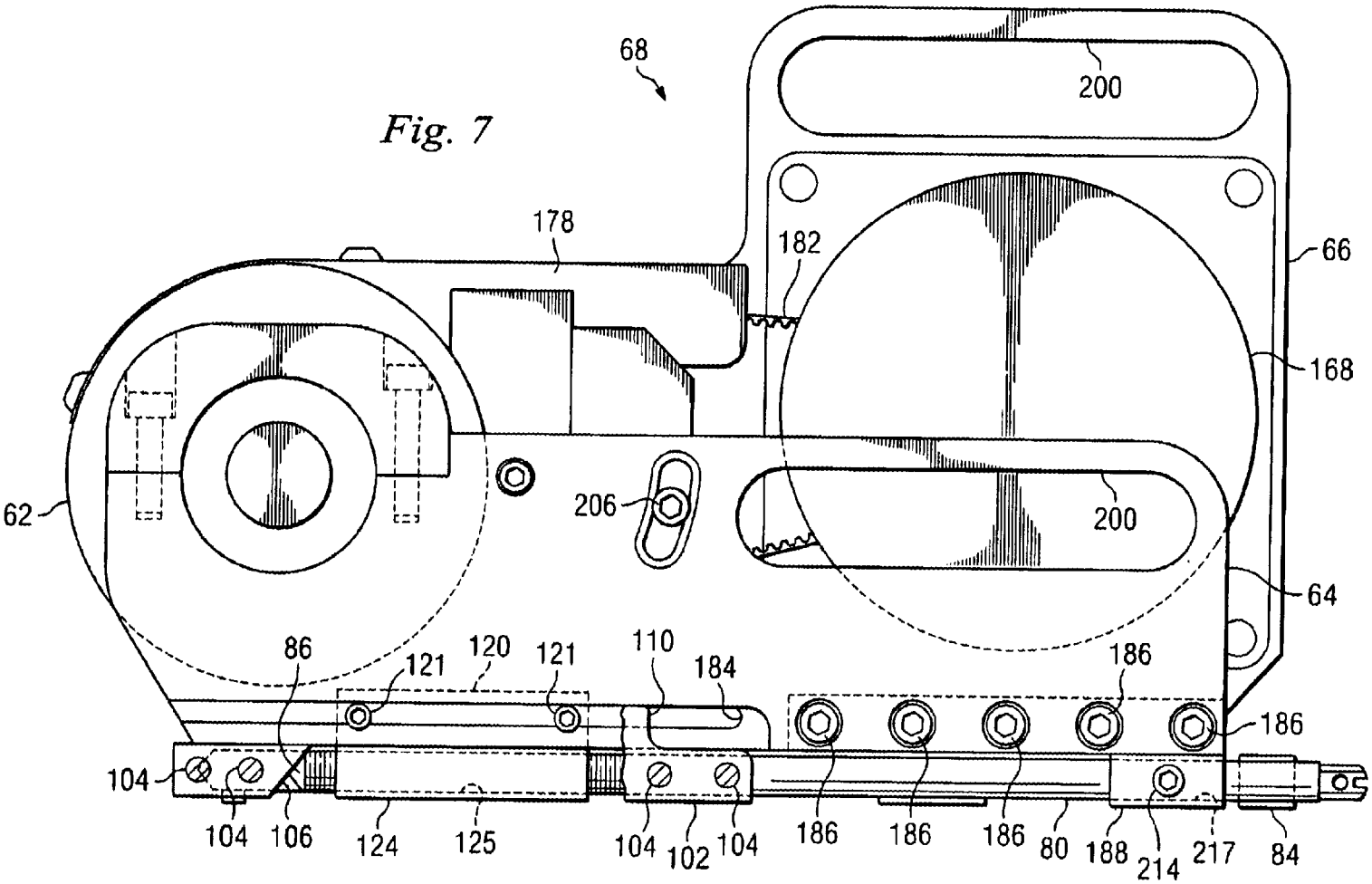
FIG. 7 is a side end view of the printer coater apparatus of the invention seen from the drive side of the press.

Referring now to FIGS. 6 and 7, a side view of printer coater apparatus 36 can be seen from the operator side and drive side respectfully. Side members 64 and 66 each comprise carrying handles 200 located on the top portion of each side member to allow for gripping and carrying printer coater 36. As seen on FIG. 7, operator side side member 66 is taller than drive side side member 64 to protect drive assembly 180, as belt guard 178 is mounted to the top of operator side member 66 to cover the moving parts. Both FIGS. 6 and 7 show printer coater 36 mounted on fixed supports 102, which are attached to the interior surfaces of the drive side and operator side of printing press frame 34 (not shown in these figures) by fixed support bolts 104. Side member slots 184, located on side frames 64 and 66, engage with the fixed support rail 110 (FIG. 9) as printer coater 36 is moved toward rotating printing surface 22 or 24.

As best seen in FIG. 7, on-stop member 80 is mounted below printer coater frame 68 in the longitudinal direction. On-stop 80 extends through spacer block 188 and adjustment block 120, both of which are attached to printer coater frame 68. As printer coater 36 is moved toward the rotating printing surface, conical end 86 of on-stop 80 touches sloped surface 106 of fixed support member 102. This establishes the on-impression position.

As seen in FIGS. 6 and 7, the orientation angle of liquid chamber 208 with respect to the surface of anilox roller 62 can be adjusted by loosening adjustment screws 206 on the chamber and sliding the screw along slot 210 until the chamber is at the desired orientation angle. Referring to FIG. 6, the position of motor 168 is adjusted relative to frame 68 by loosening and sliding bolts 172 along motor positioning slots 170 until the motor is in the desired position. Located on the bottom of side members 64 and 66 are five equally spaced bolt holes 186 for attaching base or cross member 70 to side members 64 and 66. Drip pan 246 is mounted below anilox roller 62 to collect excess falling inking or coating material.

Anilox roller 62 is rotated synchronously with blanket cylinder 22 or plate cylinder 24 by drive assembly 180, as shown in FIG. 6. Drive assembly 180 comprises an electric motor 168, small sprocket 174, large sprocket 176 and belt 182. In operation, motor 168 and connecting shaft 169 (FIG. 5) turn the sprockets simultaneously by rotating smaller sprocket 174 which pulls belt 182 to rotate large sprocket 176. Sprocket 176 and anilox roller 62 rotate synchronously, as both pieces are connected. Belt guard 178 covers the belt and sprocket assembly to prevent injury to hands or fingers.

A sectional view of printer coater frame 68 connected to the operator side 18 of press frame 34 is shown in FIG. 9. Fixed support 102 is connected to interior surface 33 of press frame 34 by a series of bolts 104. Operator side member slot 184 slideably engages with rail 110 on fixed support 102 when inserting the printer coater in position. Spacer 90 provides adequate clearance between fixed support 102 and press frame 34 so that side support 66 does not rub against press frame interior surface 33 when sliding the printer coater into position. Different sized spacers 90 can also be used to compensate for differing between frame spacing on printing presses of the same nominal printing width that are manufactured by different companies. Alternatively, fixed support 102 can be connected directly to press frame interior surface 33 without the use of spacer 90 by varying the width of the fixed support. This facilitates the use of a universal printer coater of a given printing width on presses of different manufacture. Bolts 121 attach adjustment block 120 to side member 66. Adjustment block 120 comprises threaded on-stop opening 124 and parallel lock-on opening 122. On-stop opening 124 includes a threaded interior 125 in order to receive threaded exterior portion 82 of on-stop 80 (FIG. 11). The diameter of lock-on opening 122 is slightly larger than the diameter of lock-on 76 to allow adjustment block 120 to slide along the surface of lock-on 76 when the printer coater moves between the on and off-impression positions. Drip pan 246 is connected to block 120 to catch free falling liquid or inking substance. While FIG. 9 illustrates the connection details on operator side 18 of press 16, the same could be seen in mirror image on printing press drive side 20.

Figure 10:
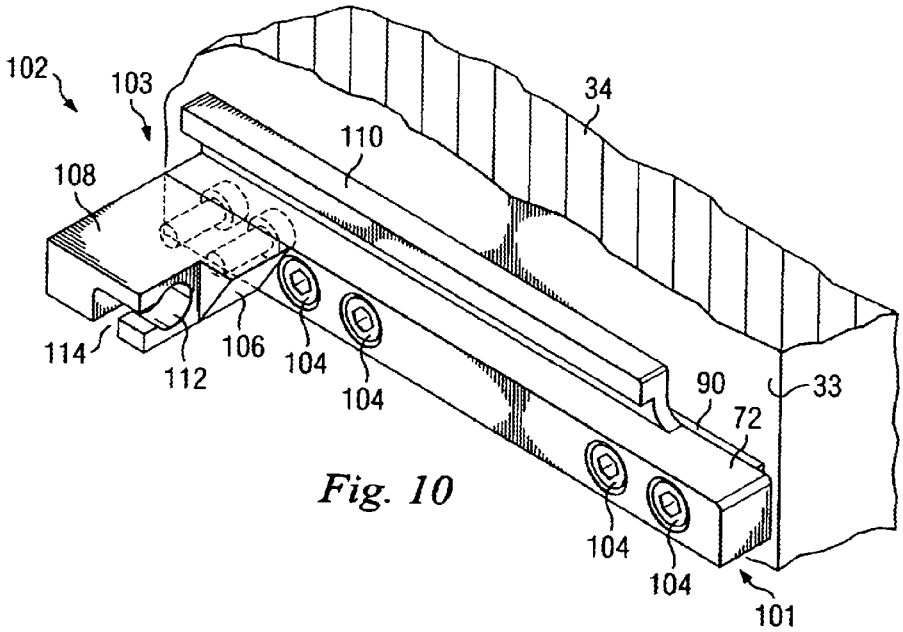
FIG. 10 shows a perspective view of one of the fixed support structures mounted on the printing press frame to support the printer coater apparatus.

FIG. 10 shows a perspective view of a right handed fixed support 102 attached to interior surface 33 of printing press frame 34. While FIG. 10 shows a right hand version for mounting on the operator side of press 16, the left hand version, for the drive side, is a mirror image of the fixed side support seen in FIG. 10. Fixed side supports 102 are mounted parallel to each other and at the same height on frame 34. Fixed supports 102 form a track on the interior surface 33 of the press frame by which printer coater 36 is supported and may slide thereon for placement in position. Fixed support 102 is attached to press frame 34 via bolts 104. A planar surface or flat 72 on first end 101 of fixed support 102 permits the operator to set printer coater side support 66 on flat 72 for alignment. While resting on flat 72, side member slot 184 (not shown herein) is aligned with rail 110 and moved forward along rail 110 to second end 103 of fixed support 102 which has a projecting portion 108 fixed thereon.

In FIG. 11 projecting portion 108 mounted on second end 103 of fixed support 102 receives the end 77 of lock-on 76 and conical end 86 of on-stop 80. Portion 108 comprises sloped surface 106, locking member chamber 112 (best seen in FIG. 10) and locking slot 114. Referring to FIGS. 10 and 11, lock-on end 77 has a pin 78 which must be aligned with slot 114 when inserting lock-on end 77 into chamber 112. When pin 78 and slot 114 are aligned, lock on end 77 can be inserted in chamber 112. Lock on grip 84 is used to rotate lock-on 76 one-quarter turn to place pin 78 in a downward and locked position, as seen in FIG. 11. While in the locked position, lock-on 76 remains stationary and cannot be moved. Lock-on 76 serves as a rail which allows printer coater 36 to slide when moving between the on and off-impression positions. In addition to functioning as a rail, lock-on 76 serves as an anchor for relative movement of the printer coater when it moves between the on and off-impression positions. As printer coater 36 is moved toward the on-impression position, conical end 86 of on-stop 80 contacts stop surface 106 to prevent any further movement in the longitudinal direction. Sloped portion 106 pushes downward on conical end 86 (FIG. 7) of on-stop 80 and thereby takes up any looseness to prevent movement which could cause vibration of the printer coater while in the on-impression position.

Referring again to FIG. 11, lock-on 76 and on-stop 80 are both located underneath cross member 70. These members are mounted parallel to each other and are oriented in the longitudinal direction. Lock-on 76 and on-stop 80 both extend through spacer block 188 and adjustment block 120. Spacer block 188 comprises two parallel openings 215 and 217 to receive lock-on 76 and on-stop 80 respectively. Opening 215 and 217 are slightly larger than the diameters of members 76 and 80 to allow the members to slide relative to block 188. Spacer block 188 is connected to cross member 70 via connecting bolts 189 and serves to maintain parallel alignment between members 76 and 80. Block 188 further comprises a set screw 214 with a nylon button 216 to control sliding movement or rotation of on-stop 80.

In FIGS. 9 and 11, adjustment block 120 and on-stop 80 are used to adjust the on-impression contact pressure between anilox roller 62 and the rotating printing surface. Threaded exterior surface portion 82 of on-stop 80 engages threaded on-stop opening 124. To adjust the contact pressure, on stop member 80 is rotated to shorten or lengthen distance "D". This allows the anilox roller position to be adjusted relative to the plate or blanket cylinder. FIG. 11 exemplifies one side of the coater apparatus 36 attached to the press frame 34; however, it should be realized the configuration occurs in mirror image on the opposite side of coater apparatus 36, not shown herein. That is, each side has a lock-on and an on-stop.

Figure 12:
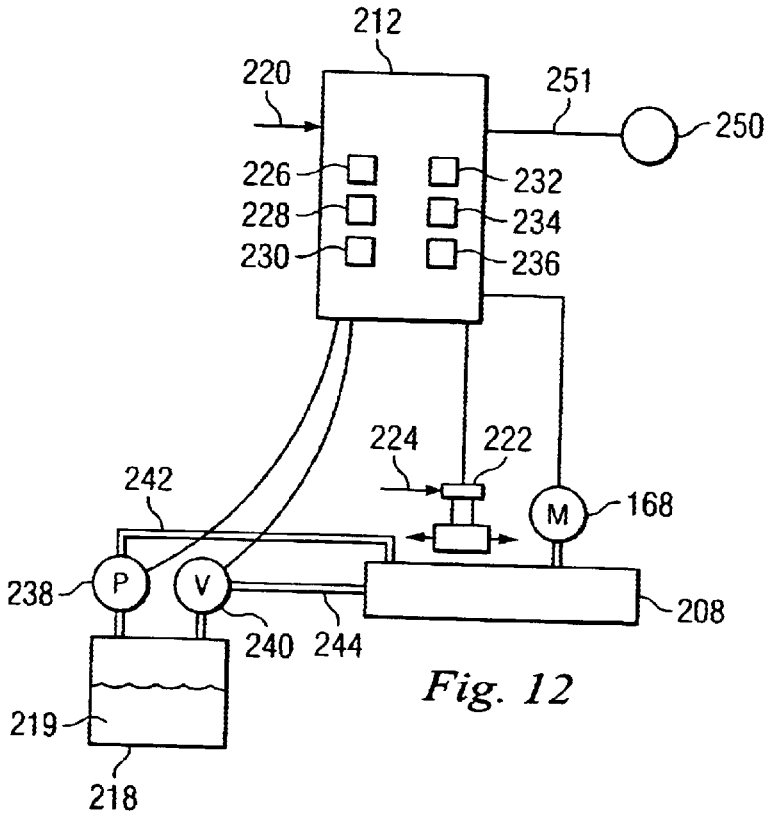
FIG. 12 is a diagram showing schematically the operation of the principal components of the printer coater controller system.

The ink or coating supply and control system is seen in FIG. 12. Control unit 212 is capable of regulating the surface speed of anilox roller 62 and the flow of inking or coating fluid into liquid chamber 208. Controller 212 comprises two inputs: a continuous power supply 220 and a voltage input 251 from tachometer 250 to regulate rotational surface speed of anilox roller 62. Controller 212 further preferably comprises a main power switch 226, a low vacuum sensor 228, a high vacuum sensor 230, a return pump controller 232, a supply pump controller 234 and an anilox controller 236 which are well known in the art.

In FIG. 12, ink or coating material 219 is pumped by pump 238 from off-press reservoir 218, through supply conduit 242 into chamber 208. The ink or coating material circulates through chamber 208 and is returned by return conduit 244 back through vacuum pump 240 to off-press source reservoir 218. The flow of ink or coating material into chamber 208 is provided in a manner as set forth in my U.S. Pat. No. 5,367,982 entitled Automatic Coating Circulation and Wash-Up System for Printing Presses, which is incorporated herein by reference. Doctor chamber 208 is preferably maintained in a vacuum condition by constantly pulling a vacuum in the manner set forth in my U.S. Pat. No. 5,207,159 entitled Coating Apparatus For Sheet-Fed Offset Rotary Printing Presses, which is incorporated herein by reference. Recirculation maintains a constant fresh supply of ink or coating material in chamber 208 at all times.

In order to rotate anilox roller 62 at or near the same surface speed as the rotating printing surface, anilox controller 236 receives the voltage signal from tachometer 250 which is mounted on the press and turns with the press. The controller interprets the input voltage and adjusts in real time the surface speed of anilox roller 62 by sending the desired output voltage to motor 168. The output voltage increases or decreases the surface speed of anilox roller 62 to establish the same surface speed as the rotating printing surface. If the printer coater apparatus is to be used on a different press of the same nominal printing width, that press is also equipped with the inexpensive tachometer 250.

Printer coater controller 212 further comprises a supply pump control 234 and a return pump control 232 to operate the system at a vacuum and to assist in circulating the inking or coating substance from reservoir 218 into chamber 208 and finally back into reservoir 218. Low vacuum and high vacuum sensors 228 and 230 continuously monitor the pressure inside chamber 208 to maintain the vacuum at all times. A pressure gauge, not shown, allows the operator to adjust the system to attain a desired vacuum pressure.

Control unit 212 may be portable so that it may be carried and placed adjacent to the printing unit where the printer coater is mounted, or it may be placed at one location with extension cables and lines for printer coater 36 running to different printing units to monitor and adjust the system if printer coater 36 is moved to different printing units.

Figure 13:
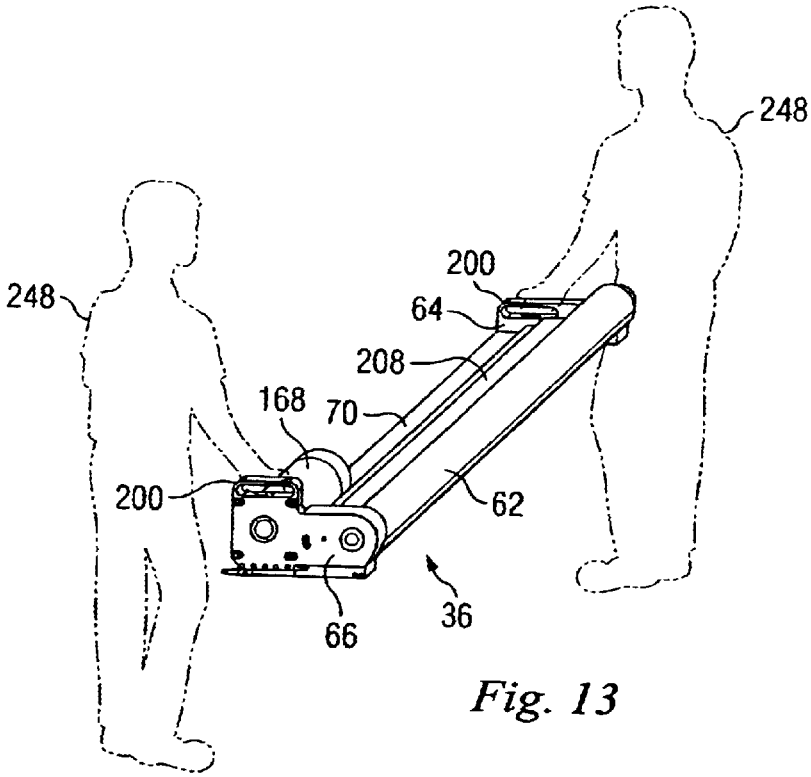
FIG. 13 shows the printer coater apparatus of the invention being carried by two press operators for installation on a printing unit.

FIG. 13 shows two humans 248 carrying printer coater apparatus 36. It is lightweight and portable so that no equipment is necessary to transport the printer coater between printing units. In order to carry and place printer coater 36 between printing units, side members 64 and 66 contain grips 200 disposed on the top portion of side members 64 and 66 to allow users to grasp and hold the unit. An exemplary compact coater printer according to the invention had an overall length of about 43 inches, an overall depth of about 12 inches and an overall height of about 7 inches. A prototype of this approximate size weighed only about 85 pounds, and it is believed improvements can be made to reduce the weight to only 75 pounds or less.

Although the invention has been described with particular reference to presently preferred embodiments thereof, it will be appreciated that various modifications, alterations, variations, etc., may be made without departing from the spirit and scope of the invention as defined in the claims.

I claim:

1. A lightweight portable compact printer coater that can be handily moved to any printing unit on a rotary offset printing press having a plurality of printing units, or to any other press of the same nominal printing width, the printer coater apparatus comprising:

a self-contained printer coater apparatus having a movable frame holding an applicator roller capable of applying a liquid film to a rotating printing surface, a means for driving the applicator roller at or near the surface speed of the rotating printing surface and a liquid film supply for replenishing the liquid film on the surface of the applicator roller;

at least one pair of fixed supports for mounting on the frame of a printing unit of a rotary offset printing unit adjacent to a rotating printing surface used in printing, said supports comprising a fixed drive side support and a fixed operator side support;

the printer coater apparatus having a drive side and an operator side wherein the drive side has a side member which removably engages the fixed drive side support and the operator side has a side member which removably engages the fixed operator side support;

the printer coater being portably liftable into and out of position wherein the drive side and operator side supports and the respective fixed drive side and fixed operator side supports are removably engaged and the apparatus is movable between an off impression position and an on impression position wherein the applicator roller is in liquid film transfer contact with the rotating printing surface; and wherein the printer coater is portably installable and reinstallable to or from a rotary printing unit on a printing press equipped with said fixed supports thereby being portable for temporary use on a printing press.

2. The lightweight portable compact printer coater of claim 1 wherein said at least one pair of fixed supports comprises a first pair of fixed supports for mounting on the frame of one rotary offset printing unit and a second pair of fixed supports for mounting on the frame of another rotary offset printing unit so that the printer coater apparatus can be moved and removably installed or reinstalled on any rotary offset printing unit.

3. The lightweight portable compact printer coater of claim 1 wherein the applicator roller comprises an anilox roller and a chambered doctor associated with the anilox roller to provide the liquid film supply for replenishing the liquid film on the surface of said roller.

4. The lightweight portable printer coater of claim 3 wherein the chambered doctor associated with the anilox roller includes a brushing means which contacts said anilox roller as it turns.

5. The lightweight portable compact printer coater of claim 3 wherein the applicator roller comprises a lightweight anilox roller made of a non-metallic composite material having a wear resistant anilox surface for applying printing ink or coating material.

6. The lightweight portable printer coater of claim 5 wherein the chambered doctor associated with the anilox roller includes a brushing means which contacts said anilox roller as it turns.

7. The lightweight portable compact printer coater of claim 5 wherein the non-metallic composite anilox roller is journaled into the side members of the apparatus at the drive side and operator side and said means for driving is a remotely controlled motor mounted on the frame of the coater printer apparatus.

8. The lightweight portable compact printer coater of claim 1 wherein a lock-on member releaseably connects the frame of the printer coater apparatus with the fixed supports and serves as an anchor for relative movement of the printer coater as it is moved between the on and the off impression positions.

9. The lightweight portable compact printer coater of claim 8 wherein an adjustable on-stop mounted on the frame of the printer coater cooperates with a stop surface on the fixed supports to establish the on impression position of the apparatus.

10. The lightweight portable compact printer coater of claim 9 wherein the said stop surface is sloped to remove any looseness between the printer coater apparatus and the fixed support when the printer coater apparatus is in the on-impression position.

11. The lightweight portable compact printer coater of claim 9 wherein a remotely controlled positioner carried by the frame of the printer coater apparatus moves the apparatus between the off impression and on impression position.

12. The lightweight portable compact printer coater of claim 9 wherein the lock-on member comprises a drive side lock-on member and an operator side lock-on member and wherein the positioner is connected via pivoting links with the drive side and operator side lock-on members.

13. The lightweight portable compact printer coater of claim 12 wherein the applicator roller comprises a lightweight anilox roller made of a non-metallic composite material having a wear resistant anilox surface for applying printing ink or coating material.

14. The lightweight portable compact printer coater of claim 12 wherein the frame of the printer coater apparatus is provided with spaced apart hand holds which facilitate manual portability of the apparatus from one printing unit to any other printing unit.

15. The lightweight portable compact printer coater of claim 14 wherein the printer coater apparatus is provided with fluid transfer lines having quick disconnect fittings.

16. The lightweight portable compact printer coater of claim 13 further including a rotary offset printing press having a plurality of rotary offset printing units each having a frame and a plate cylinder, a blanket cylinder and an impression cylinder supported for rotation in operable combination for lithographic printing of substrate passing through the printing units from the feed side to the delivery side wherein the fixed supports are mounted on the frame of one printing unit which is not the last printing unit and the self-contained printer coater apparatus is mounted thereon in a manner that permits printing or coating substrate passing through the printing unit by means of the printer coater apparatus without altering the lithographic printing capabilities of the printing unit on which the printer coater apparatus is mounted.

17. The lightweight portable compact printer coater of claim 16 wherein the fixed supports are mounted on the frame of said rotary offset printing unit at a location which permits the printer coater apparatus to be on impression with the blanket cylinder of said printing unit.

18. The lightweight portable compact printer coater of claim 16 wherein the fixed supports are mounted on the frame of said rotary offset printing unit at a location which permits the printer coater apparatus to be on impression with the plate cylinder of said printing unit.

19. The lightweight portable compact printer coater of claim 16 wherein a second pair of fixed supports are mounted respectively on the drive side and the operator side of another rotary offset printing unit of said rotary offset printing press and the self-contained printer coater apparatus can be moved from a printing/coating operation on said one rotary offset printing unit to said another rotary offset printing unit by lifting and carrying the printer coater apparatus from said one printing unit to said another printing unit.

20. The lightweight portable compact printer coater of claim 1 wherein a pair of spacers are mounted between the said pair of fixed supports and the press frame and are used to adapt said fixed supports to said press having different between frame spacing.

21. The lightweight portable compact printer coater of claim 1 wherein the said at least one pair of fixed supports comprises at least one additional pair of fixed supports having a different width than said at least one pair of fixed supports where that different width is selected to adapt the printer coater to a press having different between frame spacing.

22. A lightweight portable compact printer coater in combination with a rotary offset printing press having a plurality of offset printing units, the printer coater apparatus comprising:

a rotary offset printing press having a frame and a plurality of printing units each having a plate cylinder, a blanket cylinder, and an impression cylinder supported for rotation in operable combination wherein the surface on the plate cylinder and the surface on the blanket cylinder are rotating printing surfaces, the printing units having a delivery side and a feeder side opposite the delivery side and an inter-unit operator space between printing units;

a self-contained printer coater apparatus having an applicator roller capable of applying a liquid film to a rotating printing surface, a means for driving the applicator roller at or near the surface speed of the rotating printing surface and a liquid film supply for replenishing the liquid film on the surface of the applicator roller;

at least one pair of fixed supports mounted on the frame of a printing unit of said rotary offset printing press adjacent to a rotating printing surface used in printing, said supports comprising a fixed drive side support and a fixed operator side support;

the printer coater apparatus having a frame, a drive side and an operator side wherein the drive side has a side member which removably engages the fixed drive side support and the operator side has a side member which removably engages the fixed operator side support;

a positioner device carried by the frame of the printer coater apparatus to move the printer coater apparatus between an on impression position and an off impression position whereby while the coater is in the on impression position the applicator roller is in liquid film transfer relationship with the rotating printing surface;

the printer coater being portably liftable into and out of engagement with the fixed drive side and fixed operator side supports;

wherein the printer coater is removably installable and reinstallable to or from any printing unit on the rotary offset printing press equipped with said fixed supports, or to any other press of the same nominal printing width equipped with said fixed supports, thereby being portable for temporary use on the printing press.

23. The lightweight portable compact printer coater of claim 22 wherein said at least one pair of fixed supports comprises a first pair of fixed supports mounted on the frame of the printing unit and a second pair of fixed supports mounted on the frame of another printing unit so that the printer coater apparatus can be portably moved and removably installed on different printing units.

24. The lightweight portable compact printer coater of claim 22 wherein the applicator roller comprises an anilox roller and a chambered doctor associated with the anilox roller to provide the liquid film supply for replenishing the liquid film on the surface of said roller.

25. The lightweight portable compact printer coater of claim 24 wherein said printer coater apparatus further comprises a positioning stop member to place the surface of the anilox roller at an adjustable distance adjacent to the rotating printing surface in an operating position and a parallel locking member to prevent the coater from moving from the operating position.

26. The lightweight portable compact printer coater of claim 22 wherein the positioner device further comprises an actuator connected to at least a pair of pivoting members by a rigid link wherein actuation of the actuator causes the link to act on the pivoting members to engage the coater apparatus into the on impression position to supply liquid to the rotating printing surface or to disengage the coater apparatus into the off impression position.

27. The lightweight portable compact printer coater of claim 26 wherein the applicator roller comprises a lightweight anilox roller made of a non-metallic composite material having a wear resistant anilox surface for applying printing ink or coating material.

28. The lightweight portable compact printer coater of claim 26 wherein the actuator is pneumatically operated.

29. The lightweight portable compact printer coater of claim 26 wherein the actuator is hydraulically operated.

30. The lightweight portable compact printer coater of claim 26 wherein the actuator is electrically operated.

31. The lightweight portable compact printer coater of claim 27 wherein the drive side member and operator side member have a handle to lift and carry the printer coater into and out of position.

32. The lightweight portable compact printer coater of claim 22 wherein the rotating printing surface is the blanket cylinder and the printer coater is located on the feeder side.

33. The lightweight portable compact printer coater of claim 22 wherein the rotating printing surface is the blanket cylinder and the printer coater is located on the delivery side.

34. The lightweight portable compact printer coater of claim 22 wherein the rotating printing surface is the plate cylinder.

35. The lightweight portable compact printer coater of claim 22 wherein the liquid film supply for replenishing the liquid film on the surface of the applicator roller is attached by quick connect and disconnect mechanisms.

36. The lightweight portable compact printer coater of claim 22 wherein the said at least one pair of fixed supports comprises at least one additional pair of fixed supports having a different width than said at least one pair of fixed supports where that different width is selected to adapt the printer coater to a press having different between frame spacing.

37. The lightweight portable compact printer coater of claim 36 wherein a pair of spacers are mounted between the said pair of fixed supports and the press frame and are used to adapt said fixed supports to said press having different between frame spacing.

38. The lightweight portable compact printer coater of claim 37 wherein the pair of fixed supports further comprise slots to receive drive side and operator side side members and to slideably engage said side members thereby supporting and aligning the printer coater with the rotating printing surface.

39. The lightweight portable compact printer coater of claim 38 wherein the pair of fixed supports further comprises a stop surface to receive and engage the positioning stop member to stop forward movement of the printer coater apparatus when moving the printer coater to the on impression position.

40. The lightweight portable compact printer coater of claim 39 wherein the said stop surface is sloped to remove any looseness between the printer coater apparatus and the fixed supports when the printer coater apparatus is in the on-impression position.

41. The lightweight portable compact printer coater of claim 40 wherein the pair of fixed supports further include chambers to receive and lock the locking member to hold the printer coating apparatus in operating position.

42. A lightweight portable compact printer coater for movement to any printing unit on a rotary offset printing press having a plurality of rotary offset printing units, the printer coater apparatus comprising:

a printer coater apparatus having an applicator roller capable of applying a liquid film to a rotating printing surface, a means for driving the applicator roller at or near the surface speed of the rotating printing surface and a liquid film supply for replenishing the liquid film on the surface of the applicator roller;

at least one pair of fixed supports for mounting the printer coater on the frame of a printing unit of a rotary offset printing press with the surface of the applicator roller adjacent to the rotating printing surface, the fixed supports comprising a fixed drive side support and a fixed operator side support;

the printer coater apparatus having a frame, a drive side and an operator side wherein the drive side has a drive side member which removably engages the fixed drive side support and the operator side has an operator side member which removably engages the fixed operator side support;

an actuator device carried by the frame of the coater apparatus to move the coater apparatus between an on impression position and an off impression position whereby while the coater is in the on impression position the applicator roller touches the rotating printing surface;

the printer coater being portably liftable into and out of operating position wherein the drive side and operator side supports and the respective fixed drive side and operator side supports are removably engaged and where the surface of the applicator roller can be placed in liquid film transfer contact with the rotating printing surface;

wherein the printer coater is removably installable and reinstallabe to or from a rotary printing unit on the printing press equipped with said fixed supports thereby being portable for temporary use on a printing press.

43. The lightweight portable compact printer coater of claim 42 wherein said at least one pair of fixed supports comprises a first pair of fixed supports for mounting on the frame of one rotary offset printing unit and at least a second pair of fixed supports for mounting on the frame of another rotary offset printing unit so that the printer coater apparatus can be moved and removably installed on any rotary offset printing unit on which said at least a second pair of fixed supports is mounted.

44. The lightweight portable compact printer coater of claim 42 wherein the applicator roller comprises an anilox roller and a chambered doctor associated with the anilox roller to provide the liquid film supply for replenishing the liquid film on the surface of said roller.

45. The lightweight portable compact printer coater of claim 44 wherein the applicator roller comprises a lightweight anilox roller made of a non-metallic composite material having a wear resistant anilox surface for applying printing ink or coating material.

46. The lightweight portable compact printer coater of claim 45 wherein the chambered doctor associated with the anilox roller includes a brush for brushing the lightweight anilox roller.

47. The lightweight portable compact printer coater of claim 42 wherein the side supports further comprise a positioning stop member to place the printer coater at an adjustable distance adjacent to the rotating printing surface in an operating position and a releasable locking member to prevent the printer coater from moving from the operating position.

48. The lightweight portable compact printer coater of claim 42 wherein the actuator device further comprises an actuator device connected to at least a pair of pivoting members by a rigid link wherein actuation causes the link to act on the pivoting members to actuate the coater apparatus into the on impression position to supply liquid to the rotating printing surface or to actuate the coater apparatus into the off impression position to stop supplying liquid to the rotating printing surface.

49. The lightweight portable compact printer coater of claim 48 wherein the actuator device is pneumatically operated.

50. The lightweight portable compact printer coater of claim 48 wherein the actuator device is hydraulically operated.

51. The lightweight portable compact printer coater of claim 48 wherein the actuator device is electrically operated.

52. The lightweight portable compact printer coater of claim 42 wherein the drive side member and operator side member have a handle to lift and carry the printer coater into and out of position.

53. The lightweight portable compact printer coater of claim 42 wherein the rotating printing surface is a blanket cylinder and the printer coater is mounted on the feeder side.

54. The lightweight portable compact printer coater of claim 42 wherein the rotating printing surface is a blanket cylinder and the printer coater is mounted on the delivery side.

55. The lightweight portable compact printer coater of claim 42 wherein the rotating printing surface is a plate cylinder.

56. The lightweight portable compact printer coater of claim 42 wherein the liquid film supply for replenishing the liquid film on the surface of the applicator roller is attached by quick connect and disconnect mechanisms.

57. The lightweight portable compact printer coater of claim 42 wherein the pair of fixed supports have slots to receive the drive side member and the operator side member to engage the side members of the printer coater thereby supporting and aligning the printer coater with the rotating plate or blanket.

58. The lightweight portable compact printer coater of claim 57 wherein the pair of fixed supports further comprise stop surfaces to receive and engage the positioning stop member to stop the forward movement of the coater apparatus when moving the coater to the on impression position in response to activation of the actuator device.

59. The lightweight portable compact printer coater of claim 58 wherein the said stop surface is sloped to remove any looseness between the printer coater apparatus and the fixed supports when the printer coater apparatus is in the on-impression position.

60. The lightweight portable compact printer coater of claim 57 wherein each of the pair of fixed supports further comprises a chamber to receive and lock the locking member to prevent the coating apparatus from moving from the operating position.

61. The lightweight portable compact printer coater of claim 60 wherein the said at least one pair of fixed supports comprises at least one additional pair of fixed supports having a different width than said at least one pair of fixed supports where that different width is selected to adapt the printer coater to a press having different between frame spacing.

62. The lightweight portable compact printer coater of claim 61 wherein a pair of spacers are mounted between the said pair of fixed supports and the press frame and are used to adapt said fixed supports to said press having different between frame spacing.

63. A lightweight portable compact printer coater that can be handily moved to any printing unit on a rotary offset printing press having a plurality of printing units, or to any other press of the same nominal printing width, the printer coater apparatus comprising:

a self-contained printer coater apparatus having a movable frame holding an applicator roller capable of applying a liquid film to a rotating printing surface, a means for driving the applicator roller at or near the surface speed of the rotating printing surface and a liquid film supply for replenishing the liquid film on the surface of the applicator roller;

at least one pair of fixed supports for mounting on the frame of a printing unit of a rotary offset printing unit adjacent to a rotating printing surface used in printing, said supports comprising a fixed drive side support and a fixed operator side support;

the printer coater apparatus having a drive side and an operator side wherein the drive side has a side member which removably engages the fixed drive side support and the operator side has a side member which removably engages the fixed operator side support;

at least one pair of spacers wherein the said pair of spacers are mounted between the said pair of fixed supports and press frame to adapt said fixed supports to said press having different between frame spacing;

the printer coater being portably liftable into and out of position wherein the drive side and operator side supports and the respective fixed drive side and fixed operator side supports are removably engaged and the apparatus is movable between an off impression position and an on impression position wherein the applicator roller is in liquid film transfer contact with the rotating printing surface; and wherein the printer coater is portably installable and reinstallable to or from a rotary printing unit on a printing press equipped with said fixed supports thereby being portable for temporary use on a printing press.

* * * * *